US005110209A

United States Patent [19]

Elshoud et al.

[11] Patent Number: 5,110,209

[45] Date of Patent: May 5, 1992

[54] METHOD AND APPARATUS FOR ADJUSTING THE ALIGNMENT OF A SIGHTING DEVICE AND A PIVOTABLE MEMBER

[75] Inventors: Nicolaas P. Elshoud, Delft; Frits J. Versteeg, Rotterdam, both of Netherlands

[73] Assignee: B. V. Optische Industrie "De Oude Delft", Delft, Netherlands

[21] Appl. No.: 127,233

[22] Filed: Dec. 1, 1987

Related U.S. Application Data

[63] Continuation of Ser. No. 769,576, Aug. 26, 1985, abandoned.

[30] Foreign Application Priority Data

Aug. 31, 1984 [NL] Netherlands ..... 8402659

[51] Int. Cl.[5] ..... G01B 11/27

[52] U.S. Cl. ..... 356/138; 356/153

[58] Field of Search ..... 356/138, 153, 154; 33/286

[56] References Cited

U.S. PATENT DOCUMENTS 3,684,383 8/1972 Johansson ..... 33/286
3,734,627 5/1973 Edwards ..... 356/153
3,908,282 9/1975 Steffan ..... 33/286
4,142,799 3/1979 Barton ..... 356/153
4,191,471 3/1980 Courten et al. ..... 356/153

*Primary Examiner*—Richard A. Rosenberger
*Attorney, Agent, or Firm*—Louis E. Marn

[57] ABSTRACT

A method of adjusting the alignment of a sighting device (5) and a member (4) coupled therewith, said member being pivotable in at least one plane about a first pivot axis (3), and at least part (7) of said sighting device (5) being pivotable about a second pivot axis (6). On the pivotable member an apparatus is mounted which provides a parallel beam of radiation shining directly or indirectly on to the pivotable part (7) of the sighting device (5), and being productive of a point image at the viewing end of the sighting device. The pivotable member is moved into a plurality of different angular positions relative to the first pivot axis (3), and, if during these movements the point image is moved beyond a pre-determined tolerance range, the coupling (8) between the pivotable member and the sighting device is adjusted. The apparatus comprises a frame which is provided with means (40,41,50,51) for fastening the apparatus to the pivotable member, and carrying a source of radiation which, either directly or via an optical apparatus, such as a collimator (30,80) shines a parallel beam of radiation on to the sighting device.

26 Claims, 4 Drawing Sheets

30
41
42
43
40
$h_1$
$h_2$
50
51
52
4
60
61
62
64
65
66
67
68
69
70
71
VII

METHOD AND APPARATUS FOR ADJUSTING THE ALIGNMENT OF A SIGHTING DEVICE AND A PIVOTABLE MEMBER

This is a continuation of application Ser. No. 06/769,576, filed Aug. 26, 1985, now abandoned.

This invention relates to a method and apparatus for adjusting the alignment of a sighting device and a pivotable member coupled therewith, said member being pivotable in at least one plane about a first pivot axis, and at least part of said sighting device being pivotable about a second pivot axis.

Such a method and apparatus can be used in various situations in which an adjustable member disposed in the vicinity of a sighting device must be aligned with a remote target. An apparatus according to the present invention can be used, for example, for accurately aligning the centres of a long lathe.

An important use of the invention is to be found in military practice, in which the barrel of a gun must be aimed as accurately as possible at the point which in a given situation is observed with the sighting device. The point viewed with the sighting device is determined by the point of intersection of the cross hairs or reticule of the sighting device. This point should as much as possible coincide with the point at which the muzzle is aimed in all elevations of the barrel.

In the prior art, used for example in fighting vehicles, the pivotable part of the sighting device is coupled to the muzzle of the gun of the vehicle by means of an adjustable linkage or by means of a servo mechanism. The sighting device is adjusted by adjusting the linkage or the servo mechanism in such a manner that in a plurality of discrete elevations of the barrel the sighting device is in alignment with the barrel.

For this purpose, for example, a target marking is positioned at a distance of 1000 m, at which the barrel is aimed. Accurate aiming of the muzzle then requires a telescope, which is mounted on, or even in, the barrel.

When the muzzle has been accurately adjusted by means of such a telescope, the linkage or the servo mechanism is subsequently adjusted so that the cross hairs of the sighting device also coincide with the target marking.

These operations are subsequently repeated for other barrel elevations until the sighting device and the barrel are aligned as accurately as possible.

An additional problem is that, with a distance between target marking and fighting vehicle of about 1000 m and with a barrel elevation of, for example, 30°, the target marking should be at an altitude of about 570 m. In mountainous terrain it is perhaps possible to place a target marking hundreds of meters higher than the armoured vehicle, but in flat terrain this is impossible. In the past, therefore, balloons have been used as target markings. As a result of air currents, such balloons seldom hang still. To overcome this problem, use has further been made of artificial hills and pits, on the slopes of which the fighting vehicle was placed. With a horizontal position of the barrel and an associated low position of the target marking, an elevation, both positive and negative, can yet be simulated in this manner. A disadvantage of this technique is that it is necessary to make artificial slopes which additionally, to simulate different elevations, must be made with a plurality of different angles of inclination.

It is an object of the present invention to overcome the drawbacks outlined above.

For this purpose, according to the present invention, a method of the kind described is characterized by mounting on said pivotable member a means for providing a parallel beam of radiation shining on the pivotable part of the sighting device, said parallel beam being productive of a point image on the viewing end of the sighting device; moving said pivotable member into a different position and, if said point image is displaced during this movement, changing the coupling between the pivotable part of the sighting device and the pivotable member; and repeating this step for a desired number of angular positions until, as the pivotable member is traversing its entire swing, the point image is displaced within a pre-determined tolerance range only.

It is observed that, in principle, the first and second pivot axes are parallel to each other. In practical cases, however, deviations occur of such a nature that correction is desirable. When using the method and apparatus according to the present invention, such deviations can be observed as, in the presence of such deviations, the point image on the viewing end of the sighting device performs a horizontal movement when the pivotable member is given a different elevation. Depending on the nature of the deviation found, for example, the position of the second pivot axis can then be re-adjusted.

It is further observed that the parallel beam of radiation is preferably parallel to the longitudinal axis of the pivotable member. This is not necessary, however, so long as the beam shines on the pivotable part of the sighting device.

The invention will be described in more detail hereinafter with reference to the accompanying drawings.

FIG. 1 shows the turret of a fighting vehicle fitted with an adjustable sighting device;

FIGS. *2a–2c* show a known technique for adjusting and checking the alignment of a gun barrel of a fighting vehicle and a sighting device;

FIGS. *3a* and *3b* diagrammatically show a part of a first embodiment of an apparatus according to the present invention;

FIG. 4 diagrammatically and in side-elevational view shows a further elaboration of the apparatus shown in FIG. 3;

Figure 8:
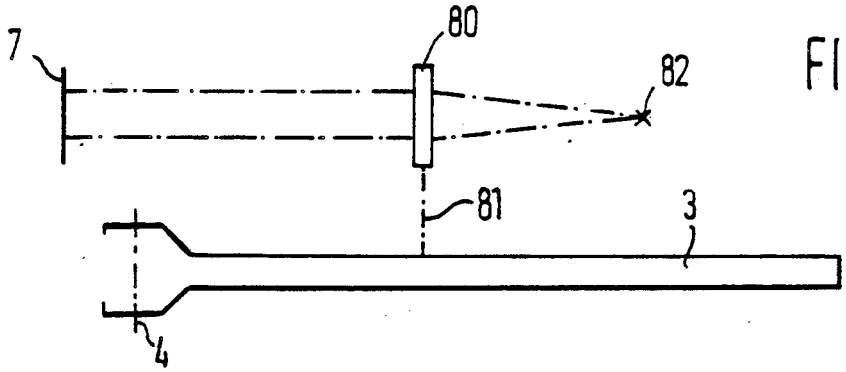
Figure 9:
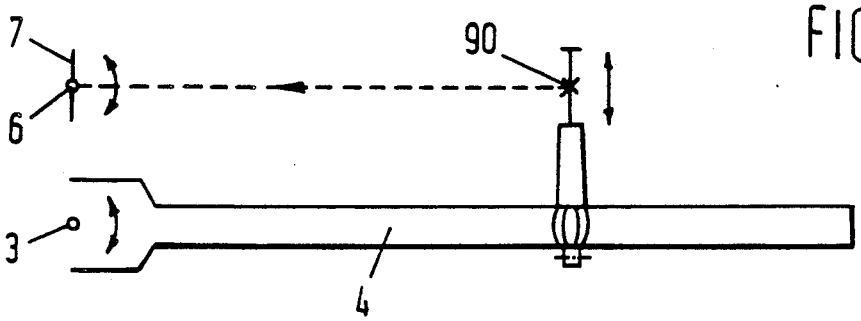

FIG. 8 diagrammatically shows a second embodiment of the present invention; and FIG. 9 diagrammatically shows a third embodiment of an apparatus according to the present invention.

Figure 1:
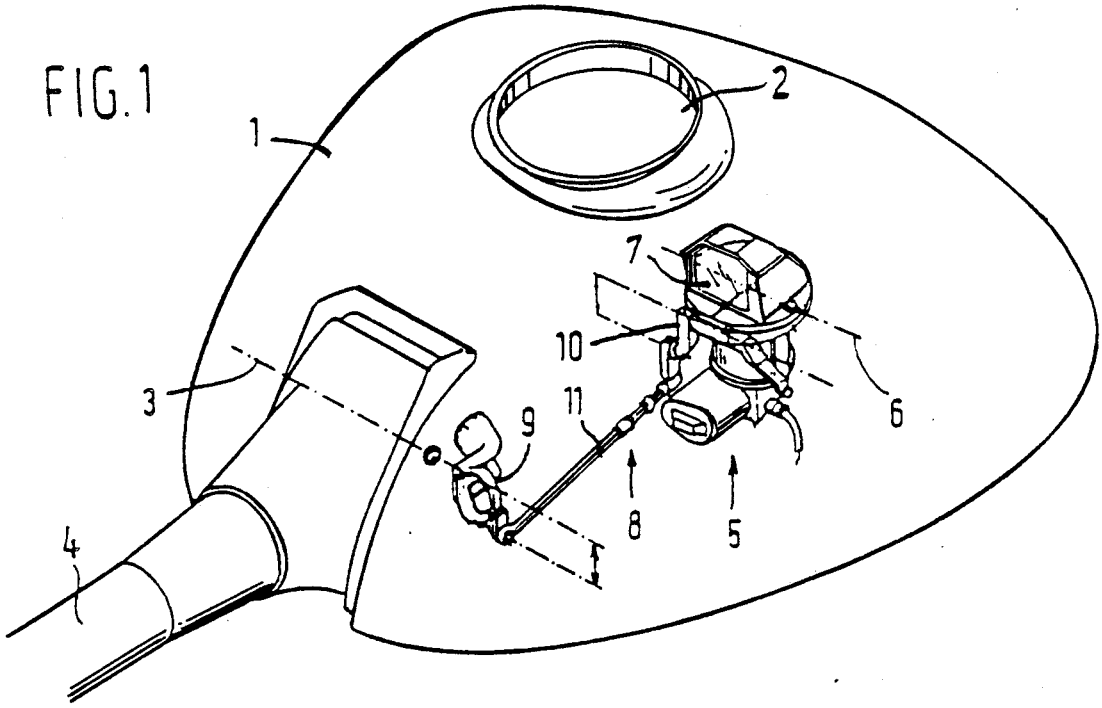

FIG. 1 shows the turret 1 of a fighting vehicle, provided with a conventional manhole 2, a gun barrel 4 pivotable about an axis 3, and a part of a sighting device 5.

The sighting device is mounted a fixed distance from the pivot axis 3 of barrel 4, and comprises a mirror 7 rotatable about a horizontal axis 6. The sighting device is mounted so that the horizontal pivot axis 6 of the mirror is parallel to the pivot axis 3 of the barrel. Deviations in the parallelism of the pivot axes 3 and 6 can be corrected as described above. As the sighting device and the barrel, upon rotation of the turret about a vertical axis, always occupy the same position relative to each other, no further adjustment in this regard is needed.

In order to cause the sighting device to be in alignment with any given elevation of the barrel, a linkage is provided, which transmits the movement of the barrel in the vertical plane to the mirror of the sighting device. Instead of a linkage, a servo mechanism is sometimes used.

The linkage 8 comprises a member 9 fixedly connected to the barrel, and a lever 10 fixedly connected to the mirror, and also an adjustable link rod 11, the length of which can be adjusted in known manner with a screw mechanism.

According to the known technique, after an initial setting of the length of connecting rod 11 or of the servo mechanism, it is checked for a plurality of discrete elevations of the barrel whether the sighting device, i.e., in this case, mirror 7, is aimed at the target marking, at which the barrel is also aimed, and if necessary the setting is changed.

FIG. 2 illustrates a known method which is used for this purpose in flat terrain.

Figure 2A:
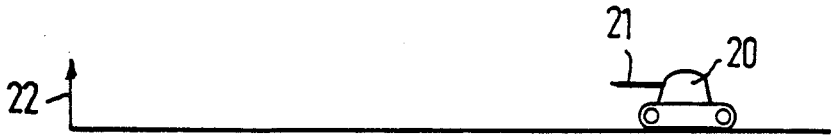
Figure 2B:
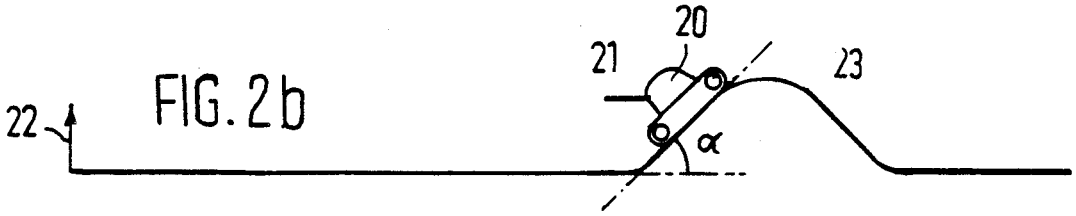

FIG. 2*a* shows a fighting vehicle 20 with a gun 21, positioned in flat terrain, and further a target marking 22 placed on the ground at a remote point. FIG. 2*b* shows the same fighting vehicle placed on the slope of a hill 23. The angle of inclination $\alpha$ of the hill corresponds to the elevation of the gun barrel, if the latter is aimed at the target marking 22. By using different slopes, the alignment between the sighting device and the gun barrel can be checked and adjusted.

Figure 2C:
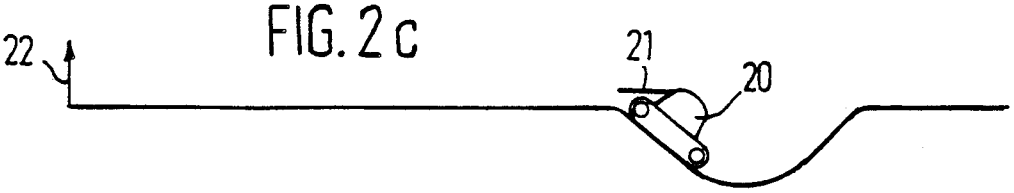

Negative elevations of the gun barrel can be simulated, for example, in the manner illustrated in FIG. 2*c*.

The method and apparatus according to the present invention make the use of slopes and remote target markings for adjusting the alignment between the sighting device and the gun barrel unnecessary.

FIG. 3 illustrates diagrammatically a part of a first embodiment of an apparatus according to the present invention. The apparatus comprises a frame, not shown in FIG. 3, which comprises means for attaching the frame to a gun barrel or other member to be aligned. Secured further to the frame is a collimator 30 and a source of radiation 31 placed in the focal point of the collimator and radiating monochromatic light of a wavelength ranging, for example, between 0.5 and 0.9 $\mu$m, in the direction of the collimator, or when the sighting device comprises a thermal image camera, energy of a wavelength in the range between 8 and 12 $\mu$m, as will be described in more detail hereinafter.

Figure 3A:
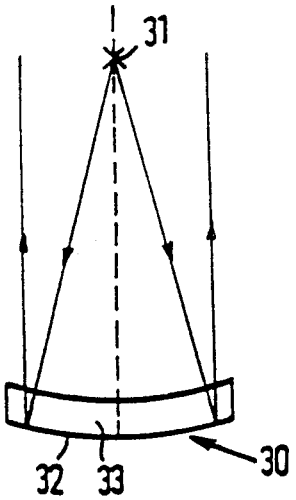
Figure 3B:
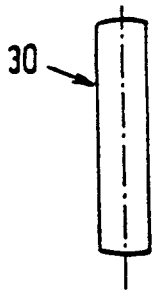

FIG. 3*a* shows collimator 30 in side-elevational view and FIG. 3*b* shows a front-elevational view of the collimator. The figure shows that the collimator is strip-shaped.

In this example, the collimator is a strip-shaped Mangin mirror comprising a glass body 32 which can be regarded as a part of a spherical lens and a reflective layer 33 to prevent, in known manner, spherical abberation if monochromatic radiation is used. The collimator could alternatively be a parabolic mirror so that it is not necessary to use monochromatic radiation, but such a parabolic form is more difficult to make.

In case the sighting device comprises a thermal-image camera, instead of glass body 33 a body of a different material, e.g. germanium, is used.

When the collimator is a Mangin mirror or a parabolic mirror, the source of radiation is, in operation, between the sighting device and the collimtor, so that the parallel beam formed by the collimator can reach the sighting device.

Figure 4:
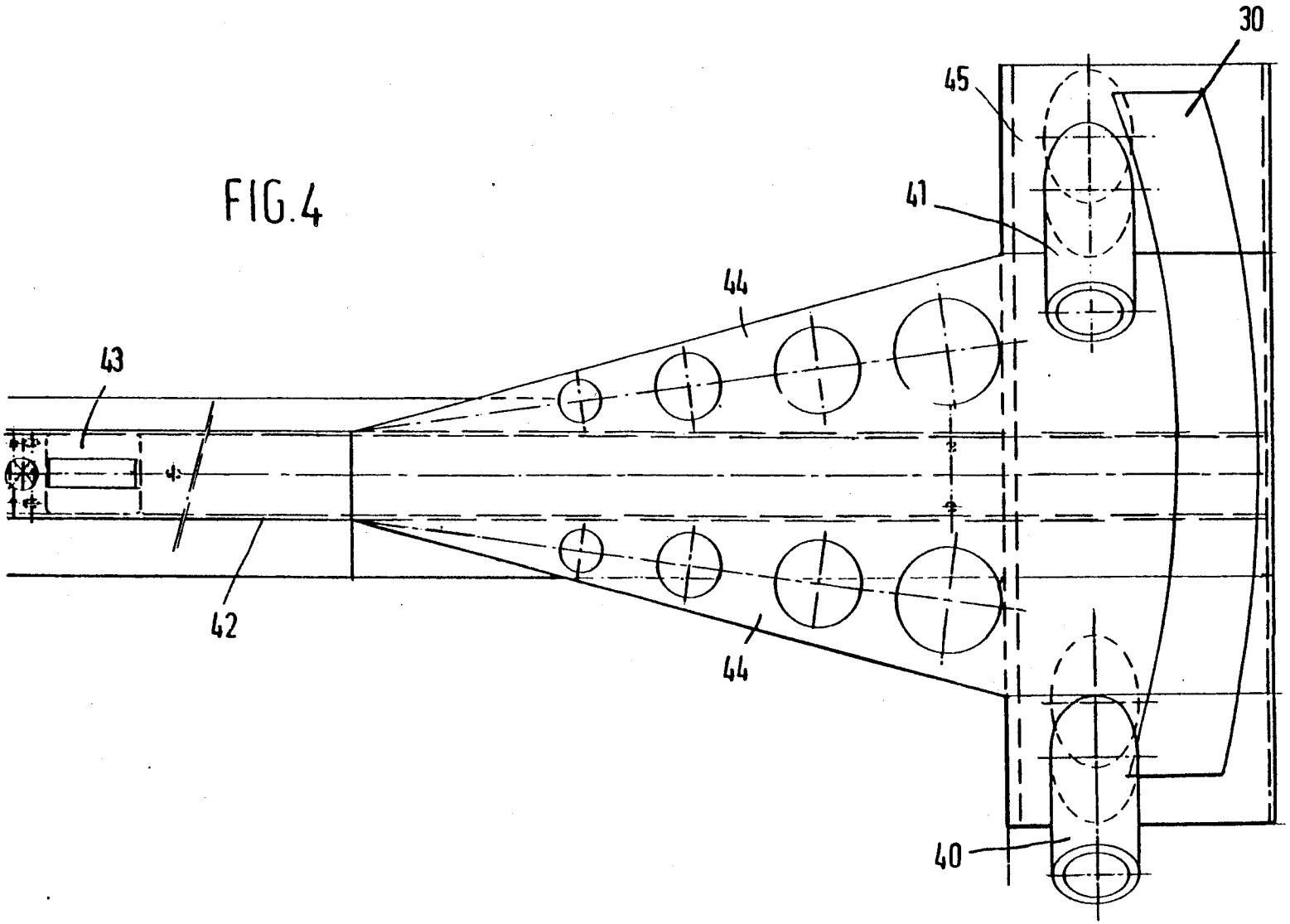

FIG. 4 shows, in side-elevational view, and diagrammatically, a further elaboraton of an apparatus according to the present invention. The collimator, again designated by 30, is mounted on a frame 45 which comprises two tubes 40, 41, shown in part, which extend obliquely laterally relatively to the collimator, and are provided at the end away from the collimator, not shown, with fastening means for fastening the apparatus to, for example, a gun barrel. The frame further comprises an arm 42 extending parallel to the optical axis of the collimator, and carrying a light or heat source 43 positioned in the focal point of the collimator, which will be described in more detail hereinafter.

In the example shown, arm 42 is rigidified with tie plates 44 which, to save weight, may be provided with holes.

To ensure a good operation of the apparatus, the light or heat source must be placed accurately in the focal point of the collimator. The arm is therefore constructed in known manner so that a change in length as a result of temperature variations, is compensated for. This can be effected, for example, by means of a construction which is sometimes used for timepiece pendulums, namely, mounting the light or heat source on an auxiliary arm that is slidable relatively to the arm in the longitudinal direction of the arm, and which auxiliary arm is fixedly secured at the end away from the collimator and in front of the light or heat source.

Naturally, in addition, known per se features may be used to adjust the position of the light or heat source initially relatively to the collimator.

Figures 5, 6, 7:
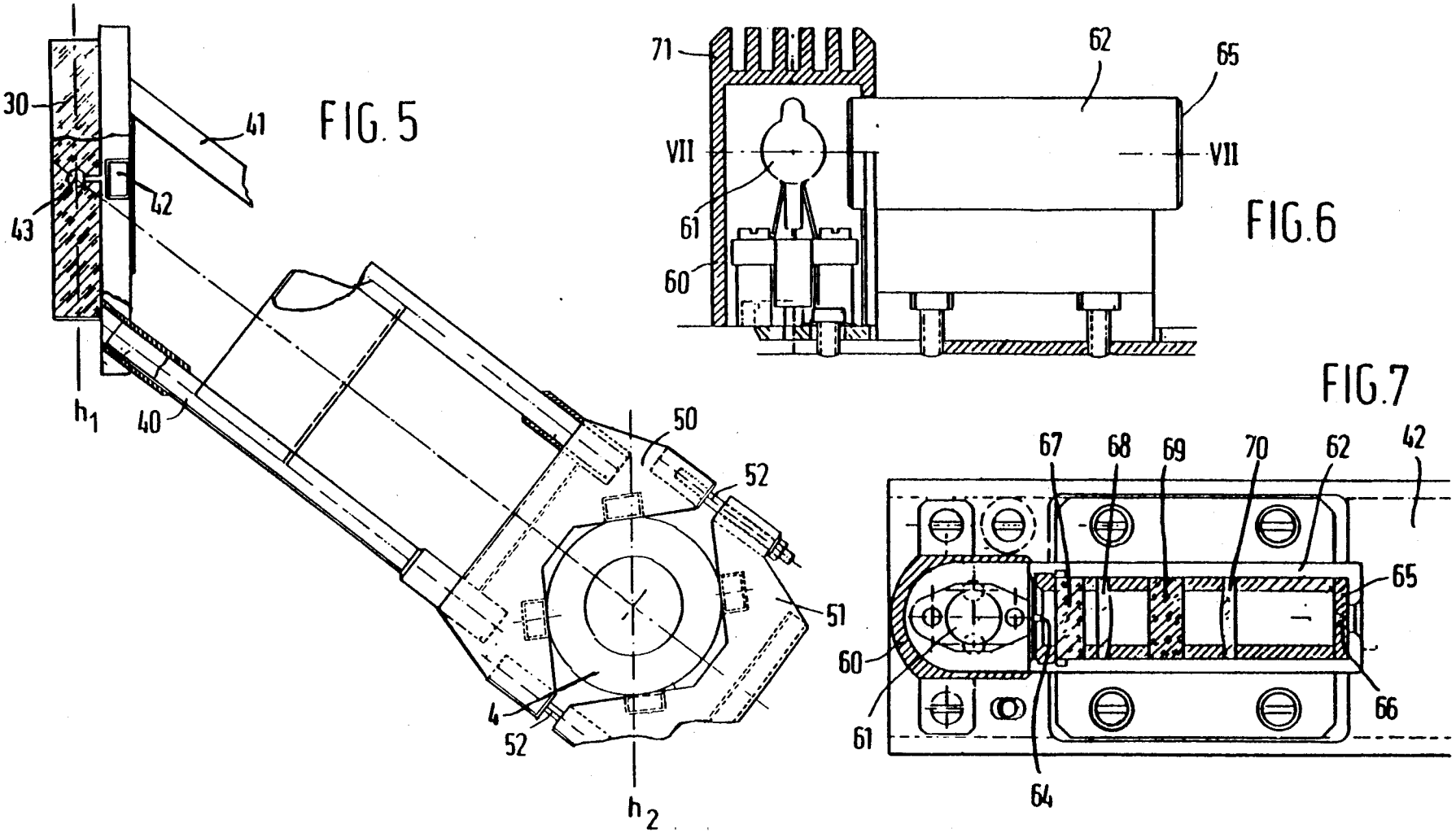
FIG. 5 shows the apparatus of FIG. 4 mounted on a gun barrel.
FIGS. 6 and 7 show the arrangement of a source of radiation for an apparatus according to the invention.

FIG. 5 diagrammatically shows the way in which an apparatus according to the invention can be secured to a gun barrel. The tubes 40, 41 attached to the frame of the apparatus, which tubes are shown in part in FIG. 4, have the ends remote from the collimator secured to one half 50 of a clamping device consisting of two halves 50, 51. The two halves of the clamping device can be clamped around the gun barrel by means of bolts 52. When properly mounted, the vertical axis $h_2$ of the gun barrel is parallel to the vertical axis $h_1$ of the collimator. The vertical plane defined by the vertical axis $h_2$ and the longitudinal axis of the gun barrel is the plane in which the gun barrel can elevate. The vertical plane defined by the vertical axis $h_1$ of the collimator and the optical axis of the collimator is parallel to the plane in which the gun barrel can elevate. The apparatus is dimensioned so that the plane containing axis $h_1$ of the collimator and the optical axis of the collimator also meet mirror 7 of the sighting device. Preferably the optical axis of the sighting device is located in this vertical plane, but this is not strictly necessary. The vertical plane does need to intersect the aperture in the conventional daylight flap placed in front of the mirror 7 of the sighting device.

The operation of the apparatus according to the invention is as follows.

When the apparatus has been mounted on the gun barrel in the manner described, the light or heat source is switched on. The diverting beam radiated is converted by the collimator into a parallel beam reflected parallel to the optical axis. Via the hole in the daylight flap placed in front of the mirror 7 of the sighting device and the mirror proper, this parallel beam reaches the optical system of the sighting device and results in a point image on the viewing end of the sighting device. Subsequently, the elevation of the barrel is changed. In the case of alignment, the point image will then remain stationary. In the case of misalignment, the linkage 8 (FIG. 1) or the servo mechanism must be re-adjusted.

In the ideal case, the point image remains in the same position during a complete swing of the barrel between the lowest and the highest elevation. A small movement corresponds to a small deviation and may be acceptable.

When the alignment between the mirror of the sighting device and the barrel, and possibly, as described before, the position of the pivot axis of the barrel, have been adjusted in this manner, the apparatus can be removed from the barrel and, without further re-adjustment, mounted on the barrel of a different gun.

In this manner, the alignment of the sighting device and the barrel of a large number of guns can be adjusted in a relatively short period of time without it being necessary to place target markings at a large distance. This can accordingly be effected at any given location, and hence in a shed and the like, and at any desired time.

The apparatus can be used in any situation, if the distance between the optical axis of the sighting device and the axis of the gun barrel is constant. If this distance varies, for example, in different types of guns, and the apparatus according to the invention should be suitable for use with such different types, tubes 40, 41 may be made of adjustable length in various known manners.

FIG. 6 shows, in side-elevational view, a light source as can be used in an apparatus according to the invention, and FIG. 7 shows a cross-sectional view, taken on the line VII—VII of FIG. 6.

The light source comprises a lamp 61 placed in a housing 60 and radiating monochromatic light of a wavelength, for example, in the range between 0.5 and 0.9 μm. The light radiated by lamp 61 is directed to the collimator by means of a tube 62 which in the vicinity of the lamp is provided with a cover 63 with an aperture 64 therein, and with a cover 65 having a pinhole 66 therein. The pinhole is in the focal point of the collimator.

In the embodiment shown, a heat filter 67, a first lens 68, an interference filter 69 and a second lens 70 are placed in tube 62.

As shown at 71, the housing 60 may be provided with cooling fins.

As described hereinbefore, the housing and the tube are mounted on arm 42 so that pinhole 66 is in the focal point of the collimator at all temperatures which occur in practice.

It is observed that, in the above, reference is made to a monochromatic light source. Such a light source may be formed in known manner by providing a "normal" light source with a colour filter. The colour filter may alternatively be placed elsewhere in the path of radiation, such as, for example, in front of the mirror of the sighting device. Also, the lens portion of the Mangin mirror may be corrected for colour; a filter is then unnecessary.

As stated before, when a parabolic mirror is used, the colour filter can be omitted.

As also stated before, instead of a light source radiating monochromatic light, a heat source can be used, if the sighting device comprises a heat-image camera. Such heat-image cameras are sensitive to radiation in the wavelenght range of between 8 and 12 μm. For this wavelength range, the collimator should be made of a material other than glass, for example, germanium. Within the range of 8–12 μm, the heat source should generate radiation with a bandwidth of about 1 μm. For this purpose a known per se filter can be used. In this situation, the mirror of the sighting device is a silver or gold mirror.

In the foregoing, we have described an apparatus with a reflecting collimator in the form of a Mangin mirror or a parabolic mirror. Instead of a reflecting collimator, however, a collimator lens can be used. The apparatus described hereinbefore then remains substantially equal, except that the source of radiation, as viewed from the sighting device, is located behind the collimator. As indicated with reference to the Mangin mirror, such a collimator lens can again be strip-shaped.

Such an embodiment is shown diagrammatically in plan view in FIG. 8. As indicated diagrammatically with a broken line 81, a collimator lens 80 is secured by means of a suitable frame to a gun barrel 3 capable of pivoting about a pivot axis 4 in a plane perpendicular to the plane of the page. Lens 80 is placed in juxtaposition to mirror 7 of the sighting device and shines a parallel beam of radiation on the mirror as a result of a source of radiation 82 placed behind mirror 80. The source of radiation is monochromatic or provided with a colour filter which, however, may alternatively be placed elsewhere in the path of radiation. As an alternative, a colour-corrected lens 80 may be used.

There is still another way of producing the desired parallel beam of radiation that must be directed onto the mirror of the sighting device. For this purpose, a laser may be used, which is secured to the pivotable member and whose light beam is shone onto the mirror of the sighting device parallel to the pivotable member, either direct (FIG. 9) or via an optical element, such as, for example, one or more mirrors, a prismatic system, or a pentaprism.

As, however, a laser (90, FIG. 9) produces a beam of very small diameter, measures must be taken to ensure that the laser beam continues to shine on the mirror of the sighting device at any elevation of the pivotable member. For this purpose, according to the invention, the laser is either reciprocated continuously and at a high rate over a certain distance in a direction transverse to the optical axis of the mirror of the sighting device and parallel to the plane of elevation of the pivotable member, or the laser is moved in the same direction depending on the elevation of the pivotable member.

In both cases the laser may be mounted on a rail and be displaced by a suitable prime mover, with means being required in the latter case which detect the elevation of the pivotable member and, in dependence thereon, control the prime mover.

In case the laser beam is directed at the mirror of the sighting device not direct, but by means of a reflecting element, it is alternatively possible to have the laser proper in a stationary position relative to the pivotable member. The reflecting element should then be positioned so that at all times it receives the laser beam and subsequently shines it onto the mirror of the sighting device. In this arrangement the beam reflected by the reflecting element should always be parallel to the incident laser beam, but the distance between the two beams should be variable. This last can be realised, for example, by means of two reflecting surfaces placed at an angle of 90° relatively to each other, and whose line of intersection extends transversely to the pivotal plane of the pivotable member, with the mirror surfaces jointly pivoting about the line of intersection or being moved up and down transversely to the line of intersection.

It is observed that, by way of illustration, the invention has been described in the above with reference to some embodiments of an apparatus according to the invention which are suitable for use in fighting vehicles. Other uses, with adaptation of the shape of the frame and the fastening means, will readily occur to those skilled in the art. Thus one may be thinking of guns with a sighting device not mounted on fighting vehicles, but also of civil uses, such as the alignment of the centres of a long lathe, or the adjustment of the alignment between two telescopes of an observatory.

Such applications will readily occur to those skilled in the art without departing from the scope of the invention.

We claim:

1. A method of adjusting the alignment of a sighting device and a member having a longitudinal axis coupled therewith, said member being pivotable in at least one plane, about a first pivot axis, and at least part of said sighting device being pivotable about a second pivot axis, comprising the steps of:

(a) mounting on said member a source means for generating a beam of radiation shining on said pivotable part of said sighting device, said beam of radiation being productive of a point image on a viewing end of said sighting device;

(b) moving said pivotable member into a different position and, if said point image is displaced during said movement, changing coupling between said pivotable part of said sighting device and said member; and (c) repeating step (b) for a predetermined number of angular positions until, as said member is traversing on entire swing, said point image is displaced within a predetermined tolerance range.

2. A method according to claim 1, characterized in that the parallel beam of radiation is provided by a laser that is continuously reciprocated, at a high rate, in a direction transverse to the optical axis of the pivotable part of the sighting device.

3. A method as claimed in claim 1, characterized in that the parallel beam of radiation is provided by a laser which, depending on the angular position of the pivotable member, is moved in a direction transverse to the optical axis of the pivotable part of the sighting device.

4. A method as claimed in claim 1, characterized in that the parallel beam of radiation is provided by a laser aimed at an optical arrangement which has at least some successive positions in which it directs the beam of radiation onto the pivotable part of the sighting device and that the optical arrangement is continuously reciprocated between these positions at a high rate.

5. A method as claimed in claim 1, characterized in that the parallel beam of radiation is provided by a laser aimed at an optical arrangement which has at least some successive positions in which it directs the beam of radiation on to the pivotable part of the sighting device and that the position of the optical arrangement is adjusted depending on the angular position of the pivotable member.

6. A method as claimed in claim 1, characterized in that the parallel beam is provided by a parabolic mirror with a source of radiation disposed in the focal point thereof.

7. A method as claimed in claim 1, characterized in that the parallel beam is provided by a collimator lens with a source of radiation placed in the focal point thereof.

8. A method as claimed in claim 1, characterized in that the parallel beam is provided by a reflecting collimator.

9. Apparatus for adjusting the alignment of a sighting device and a member coupled therewith, said member being pivotable in at least one plane about a first pivot axis, and at least part of said sighting device being pivotable about a second pivot axis, characterized by a laser attached to a frame, said frame including fastening means for fastening the apparatus to the pivotable member, the laser being aimed at the pivotable part of the sighting device and being mounted so as to be movable on a rail extending transversely to the optical axis of the pivotable part of the sighting device and parallel to the plane in which the pivotable member can pivot.

10. Apparatus according to claim 9, characterized in that the laser is not aimed at the pivotable part of the sighting device and that the frame carries an optical system spaced from said laser and arranged to direct the laser beam to the pivotable part of the sighting device.

11. Apparatus for adjusting the alignment of a sighting device and a member coupled therewith, said member being pivotable in at least one plane about a first pivot axis, and at least part of said sighting device being pivotable about a second pivot axis, characterized by a laser attached to a frame, said frame including fastening means for fastening the apparatus to the pivotable member, and by an optical system mounted on said frame, which receives said laser beam and directs it to the pivotable part of the sighting device, the optical system having at least some successive positions in which it directs the laser beam to the pivotable part of the sighting device and being movable between these positions.

12. Apparatus to be used for adjusting the alignment of a sighting device and a member having a longitudinal axis coupled therewith, said member being pivotable in at least one plane about a first pivot axis, and at least part of said sighting device being pivotable about a second pivot axis, characterized by a collimator having an optical axis attached to a frame, said frame including fastening means for fastening said apparatus to said member in a manner such that said optical axis of said collimator is substantially directed to said pivotable part of said sighting device, said frame provided with virtually a point source of radiation disposed in a focal point of said collimator.

13. Apparatus as claimed in claim 12, characterized in that the collimator is a Mangin mirror including a spherical glass lens provided on the side remote from the focal point with a reflecting layer; and that the source of radiation is a light source.

14. Apparatus as claimed in claim 13, characterized in that the Mangin mirror is strip-shaped.

15. Apparatus as claimed in claim 12, characterized in that the collimator is a collimator lens.

16. Apparatus as claimed in claim 15, characterized in that the collimator lens is strip-shaped.

17. Apparatus as claimed in claim 12, characterized in that the collimator is a parabolic mirror.

18. Apparatus as claimed in any of claims 9–16, characterized in that the source of radiation radiates monochromatic light of a wavelength in the wavelength range of between 0.5 and 0.9 $\mu$m.

19. Apparatus as claimed in any of claims 12–17, characterized in that the source of radiation comprises a lamp which, via a lens system placed in a tube and an interference filter, shines light upon a pinhole provided in a cover of said tube at the end remote from the lens, said pinhole being disposed in the focal point of the collimator.

20. Apparatus as claimed in any of claims 12–16, characterized in that the source of radiation is a light source and that a filter passing monochromatic light only is disposed in the path of radiation.

21. Apparatus as claimed in any of claims 12–16, characterized in that the collimator is colour-corrected.

22. Apparatus as claimed in claim 12, characterized in that the collimator is a Mangin mirror including a spherical germanium body which at the side remote from the focal point of the collimator is provided with a reflecting layer; and that the source of radiation is a monochromatic heat source.

23. Apparatus as claimed in claim 22, characterized in that the Mangin mirror is strip-shaped.

24. Apparatus as claimed in claim 22, characterized in that the heat source generates radiation of a wavelength in the range of between 8 and 12 μm.

25. Apparatus as claimed in claim 12, characterized in that the fastening means comprise at least one tube extending laterally relatively to the optical axis of the collimator, said tube being provided at the end remote from the collimator with a clamping device for attaching the apparatus to the pivotable member.

26. Apparatus as claimed in claim 25, characterized in that the length of said at least one tube is adjustable.

* * * * *